US009850904B2

(12) United States Patent
Toyama

(10) Patent No.: US 9,850,904 B2
(45) Date of Patent: Dec. 26, 2017

(54) SCROLL COMPRESSOR

(71) Applicant: DAIKIN INDUSTRIES, LTD., Osaka-shi, Osaka (JP)

(72) Inventor: Toshiyuki Toyama, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 123 days.

(21) Appl. No.: 14/911,256

(22) PCT Filed: Aug. 8, 2014

(86) PCT No.: PCT/JP2014/004161
§ 371 (c)(1),
(2) Date: Feb. 9, 2016

(87) PCT Pub. No.: WO2015/022775
PCT Pub. Date: Feb. 19, 2015

(65) Prior Publication Data

US 2016/0195090 A1 Jul. 7, 2016

(30) Foreign Application Priority Data

Aug. 10, 2013 (JP) ..... 2013-167182

(51) Int. Cl.
*F04C 29/02* (2006.01)
*F04C 23/00* (2006.01)
(Continued)

(52) U.S. Cl.
CPC ..... *F04C 29/021* (2013.01); *F04C 18/0215* (2013.01); *F04C 23/008* (2013.01);
(Continued)

(58) Field of Classification Search
CPC .. F04C 18/0215; F04C 23/008; F04C 27/001; F04C 27/005; F04C 29/0057; F04C 29/021; F04C 29/023
(Continued)

(56) References Cited

U.S. PATENT DOCUMENTS

2004/0247474 A1 12/2004 Kitaura et al.
2009/0191081 A1* 7/2009 Lee ..... F04C 18/0215 418/55.6
2010/0111741 A1* 5/2010 Chikano ..... F04C 18/0253 418/55.2

FOREIGN PATENT DOCUMENTS

JP 59-49389 A 3/1984
JP 4-78330 U 7/1992
(Continued)

OTHER PUBLICATIONS

European Search Report of corresponding EP Application No. 14 83 6126.4 dated Mar. 22, 2017.
(Continued)

*Primary Examiner* — Mark Laurenzi
*Assistant Examiner* — Dapinder Singh
(74) *Attorney, Agent, or Firm* — Global IP Counselors, LLP

(57) ABSTRACT

A scroll compressor includes a compression mechanism having a fixed scroll and an orbiting scroll, a drive shaft engaging with the orbiting scroll, and a casing housing the compression mechanism and the drive shaft. An orbiting scroll thrust sliding surface is pressed against and in sliding contact with a fixed scroll thrust sliding surface. One of the thrust sliding surfaces is provided with an oil groove. A bearing oil supply passage provided inside the drive shaft does not communicate with the oil groove and is used to supply the lubricating oil in an oil reservoir in the casing to a bearing of the drive shaft. A sliding surface oil supply passage is used to supply the lubricating oil in the oil reservoir to the oil groove. The sliding surface oil supply passage has a sliding surface main passage provided inside the drive shaft.

6 Claims, 8 Drawing Sheets

(51) Int. Cl.
*F04C 18/02* (2006.01)
*F04C 27/00* (2006.01)
*F04C 29/00* (2006.01)

(52) U.S. Cl.
CPC ..... *F04C 27/001* (2013.01); *F04C 29/0057* (2013.01); *F04C 29/023* (2013.01); *F04C 27/005* (2013.01)

(58) Field of Classification Search
USPC ..... 418/55.1–55.6
See application file for complete search history.

(56) References Cited

FOREIGN PATENT DOCUMENTS

| | | | |
|---|---|---|---|
| JP | 2003-294037 | A | 10/2003 |
| JP | 3731068 | B2 | 1/2006 |
| JP | 2013-60899 | A | 4/2013 |

OTHER PUBLICATIONS

International Preliminary Report of corresponding PCT Application No. PCT/JP2014/004161 dated Feb. 16, 2016.
International Search Report of corresponding PCT Application No. PCT/JP2014/004161 dated Oct. 28, 2014.

* cited by examiner

SCROLL COMPRESSOR

CROSS-REFERENCE TO RELATED APPLICATIONS

This U.S. National stage application claims priority under 35 U.S.C. §119(a) to Japanese Patent Application No. 2013-167182, filed in Japan on Aug. 10, 2013, the entire contents of which is hereby incorporated herein by reference.

TECHNICAL FIELD

The present invention relates to a scroll compressor configured to compress a refrigerant or any other given fluid.

BACKGROUND ART

A scroll compressor is widely used to compress a refrigerant, air, or any other given fluid. For example, Japanese Patent Publication No. 3731068 discloses a hermetically sealed scroll compressor. The scroll compressor includes a vertically elongated cylindrical casing, a compression mechanism, and an electric motor. The compression mechanism and the electric motor are housed in the casing. The compression mechanism is arranged over the electric motor and coupled to the electric motor via a drive shaft. The compression mechanism includes a fixed scroll and an orbiting scroll. The orbiting scroll has an end plate including a wrap provided to protrude from the front side thereof and a cylindrical portion provided to protrude from the rear side thereof. The wrap of the orbiting scroll engages with a wrap of the fixed scroll, thereby forming a compression chamber between them. The end plate of the orbiting scroll further has a thrust sliding surface which comes into sliding contact with a thrust sliding surface of the fixed scroll.

The end plate of the orbiting scroll is provided with an oil groove and a communication passage. The oil groove is a recessed groove which opens through the thrust sliding surface of the end plate and is formed to surround the wrap of the orbiting scroll. This oil groove communicates, via the communication passage, with the inner space of the cylindrical portion, which further communicates with an oil reservoir that comes to have a high pressure during operation. The pressure in the compression chamber adjacent to the oil groove is almost as high as the pressure of a low-pressure refrigerant sucked into the compression chamber, and is lower than the pressure in the oil groove. Thus, the pressure difference caused between the oil groove and the compression chamber allows a sufficient amount of lubricating oil to be supplied to the thrust sliding surfaces. This reduces the frictional force produced between the respective thrust sliding surfaces of the orbiting and fixed scrolls, and eventually reduces the power consumption of the electric motor.

SUMMARY

Technical Problem

In the scroll compressor disclosed in Japanese Patent Publication No. 3731068, if a sufficiently high pressure acts on the rear side of the end plate of the orbiting scroll, the orbiting scroll will be pressed strongly against the fixed scroll, and therefore, will not tilt. However, in a state of operation in which the pressure acting on the rear side of the end plate does not become so high (e.g., in a state of operation in which the refrigerant discharged from the compression mechanism has a very low pressure), the orbiting scroll sometimes tilts so much as to increase the clearance between the respective thrust sliding surfaces of the orbiting and fixed scrolls. Such an increase in clearance may cause a steep fall in the pressure in the oil groove.

The oil groove communicates with a bearing of the compression mechanism via the communication passage and an oil supply passage in the drive shaft. Thus, if the orbiting scroll tilts so much as to cause a steep fall in the pressure in the oil groove, the pressure in the oil supply passage communicating with the oil groove may also fall to the point that the lubricating oil is allowed to flow backward from the bearing into the oil supply passage by way of a branch passage. In that case, the bearing could not be lubricated sufficiently to possibly cause seizure and other inconveniences.

In view of the foregoing background, it is therefore an object of the present invention to increase the reliability of a scroll compressor.

Solution to the Problem

A first aspect of the present disclosure is directed to a scroll compressor comprising: a compression mechanism (20) having a fixed scroll (30) and an orbiting scroll (40); a drive shaft (60) engaging with the orbiting scroll (40); and a casing (15) housing the compression mechanism (20) and the drive shaft (60), and configured to make the compression mechanism (20) compress a fluid and discharge the fluid into the casing (15). The fixed scroll (30) has a fixed scroll thrust sliding surface (35) which comes into sliding contact with the orbiting scroll (40). An end plate (41) of the orbiting scroll (40) has an orbiting scroll thrust sliding surface (45) which is pressed against, and comes into sliding contact with, the fixed scroll thrust sliding surface (35). Either the orbiting scroll thrust sliding surface (45) or the fixed scroll thrust sliding surface (35) is provided with an oil groove (87) into which lubricating oil flows. The scroll compressor has a bearing oil supply passage (70) which is provided inside the drive shaft (60), does not communicate with the oil groove (87), and is used to supply the lubricating oil in an oil reservoir (18) in the casing (15) to a bearing of the drive shaft (60), and a sliding surface oil supply passage (80) which is used to supply the lubricating oil in the oil reservoir (18) to the oil groove (87). The sliding surface oil supply passage (80) has a sliding surface main passage (84) provided inside the drive shaft (60).

According to the first aspect of the present disclosure, when the orbiting scroll (40) is driven by the drive shaft (60), a fluid is sucked into, and compressed by, the compression mechanism (20), which then discharges the compressed fluid into the casing (15). Thus, the lubricating oil accumulated in the casing (15) comes to have substantially the same pressure as the fluid discharged from the compression mechanism (20). The lubricating oil in the casing (15) is supplied to the bearing of the compression mechanism (20) through the bearing oil supply passage (70).

In the compression mechanism (20) according to the first aspect, the orbiting scroll (40) is pressed against the fixed scroll (30) to ensure that the compression chamber is sealed hermetically with reliability. In addition, the respective thrust sliding surfaces (45, 35) of the orbiting and fixed scrolls (40, 30) come into sliding contact with each other. In the compression mechanism (20), either the orbiting scroll thrust sliding surface (45) or the fixed scroll thrust sliding surface (35) is provided with an oil groove (87), which communicates with an oil reservoir (18) in the casing (15)

through a sliding surface oil supply passage (80). Thus, the lubricating oil in the oil groove (87) comes to have substantially the same pressure as the lubricating oil accumulated in the casing (15). The lubricating oil that has flowed from the oil reservoir (18) into the oil groove (87) through the sliding surface oil supply passage (80) is supplied to the orbiting scroll and fixed scroll thrust sliding surfaces (45, 35).

In this compression mechanism (20), the orbiting scroll (40) sometimes tilts. In that case, the clearance between the orbiting scroll and fixed scroll thrust sliding surfaces (45, 35) may increase so much as to cause a steep fall in pressure in the oil groove (87). In this compression mechanism (20), however, the bearing oil supply passage (70) does not communicate with the oil groove (87). That is why even if the pressure in the oil groove (87) fell steeply, the pressure in the bearing oil supply passage (70) would not change.

According to the first aspect, since the sliding surface main passage (84) is provided inside the drive shaft (60), there is no need to increase the size of a core hole to be cut through some member of the scroll compressor (10) (e.g., the stator (51) of the electric motor (50)) in order to provide a passage to supply oil to the oil groove (87). Thus, the performance of the scroll compressor (10) does not have to be sacrificed to supply oil to the orbiting scroll and fixed scroll thrust sliding surfaces (45, 35).

A second aspect of the present disclosure is an embodiment of the first aspect described above. In the second aspect, the sliding surface oil supply passage (80) is configured such that a pressure difference between the oil reservoir (18) and the oil groove (87) causes the lubricating oil to flow through the sliding surface oil supply passage (80).

According to the second aspect of the present disclosure, if, while the compression mechanism (20) is operating, the orbiting scroll (40) tilts so much as to cause a fall in pressure in the oil groove (80), the pressure difference between the oil reservoir (18) in the casing (15) and the oil groove (87) causes the lubricating oil in the oil reservoir (18) to flow through the sliding surface oil supply passage (80) toward the oil groove (87).

A third aspect of the present disclosure is an embodiment of the second aspect described above. In the third aspect, the sliding surface oil supply passage (80) is provided with a throttle (86) configured to control a flow rate of the lubricating oil.

If the orbiting scroll (40) tilts while the compression mechanism (20) is operating, the clearance between the orbiting and fixed scroll thrust sliding surfaces (45, 35) increases significantly. As a result, the lubricating oil flows out of the oil groove (87) so easily that the flow rate of the lubricating oil flowing through the sliding surface oil supply passage (80) sometimes becomes too high.

According to the third aspect, however, the sliding surface oil supply passage (80) is provided with a throttle. Thus, even if the clearance between the orbiting and fixed scroll thrust sliding surfaces (45, 35) has increased significantly, the flow rate of the lubricating oil flowing through the sliding surface oil supply passage (80) is controllable by the throttle (86).

A fourth aspect of the present disclosure is an embodiment of the third aspect described above. In the fourth aspect, the throttle (86) is configured as a rod member (89) which is inserted into the sliding surface oil supply passage (80) and of which an outer periphery has a spiral groove that allows the lubricating oil to flow therethrough.

According to the fourth aspect of the present disclosure, by inserting a rod member (89) with a spiral groove into the sliding surface oil supply passage (80), a narrow spiral passage is formed on the outer periphery of the rod member (89) in the sliding surface oil supply passage (80). Thus, the lubricating oil that has flowed into the sliding surface oil supply passage (80) has its flow rate controlled by the narrow spiral passage on the outer periphery of the rod member (89).

A fifth aspect of the present disclosure is an embodiment of the first aspect described above. In the fifth aspect, the compression mechanism (20) has a housing (25) through which the drive shaft (60) inserted extends. The sliding surface oil supply passage (80) further includes a first connecting passage (81) provided inside the fixed scroll (30) and communicating with the oil groove (87), a second connecting passage (82) provided inside the housing (25) and communicating with the first connecting passage (81), and a third connecting passage (83) provided inside the drive shaft (60) and communicating with the second connecting passage (82) and the sliding surface main passage (84).

According to the fifth aspect of the present disclosure, the first, second, and third connecting passages (81, 82, 83) communicate with each other. This thus allows the lubricating oil from the sliding surface main passage (84) to be supplied to the oil groove (87).

A sixth aspect of the present disclosure is an embodiment of the fifth aspect described above. In the sixth aspect, an outer peripheral surface of the drive shaft (60) is provided with a lower ring groove (78A) configured to collect the lubricating oil that flows downward after having been supplied onto the bearing, and an oil supply ring groove (88) provided under the lower ring groove (78A) and communicating with the second and third connecting passages (82, 83).

According to the sixth aspect of the present disclosure, an oil supply ring groove (88) is provided under a lower ring groove (78A) configured to collect the lubricating oil. This thus allows a shortage of the lubricating oil on the bearing to be avoided even if the pressure in the oil groove (87) has fallen.

A seventh aspect of the present disclosure is an embodiment of the fifth aspect described above. In the seventh aspect, an outer peripheral surface of the drive shaft (60) is provided with an upper ring groove (78B) configured to collect the lubricating oil that flows upward after having been supplied onto the bearing, and an oil supply ring groove (88) provided over the upper ring groove (78B) and communicating with the second and third connecting passages (82, 83).

According to the seventh aspect of the present disclosure, an oil supply ring groove (88) is provided over an upper ring groove (78B) configured to collect the lubricating oil. This thus allows a shortage of the lubricating oil on the bearing to be avoided even if the pressure in the oil groove (87) has fallen.

Advantages of the Invention

A scroll compressor according to the present disclosure allows a shortage of the lubricating oil on the bearing to be avoided even if the orbiting scroll tilts, and therefore, may have its reliability increased.

DESCRIPTION OF EMBODIMENTS

Figure 1:
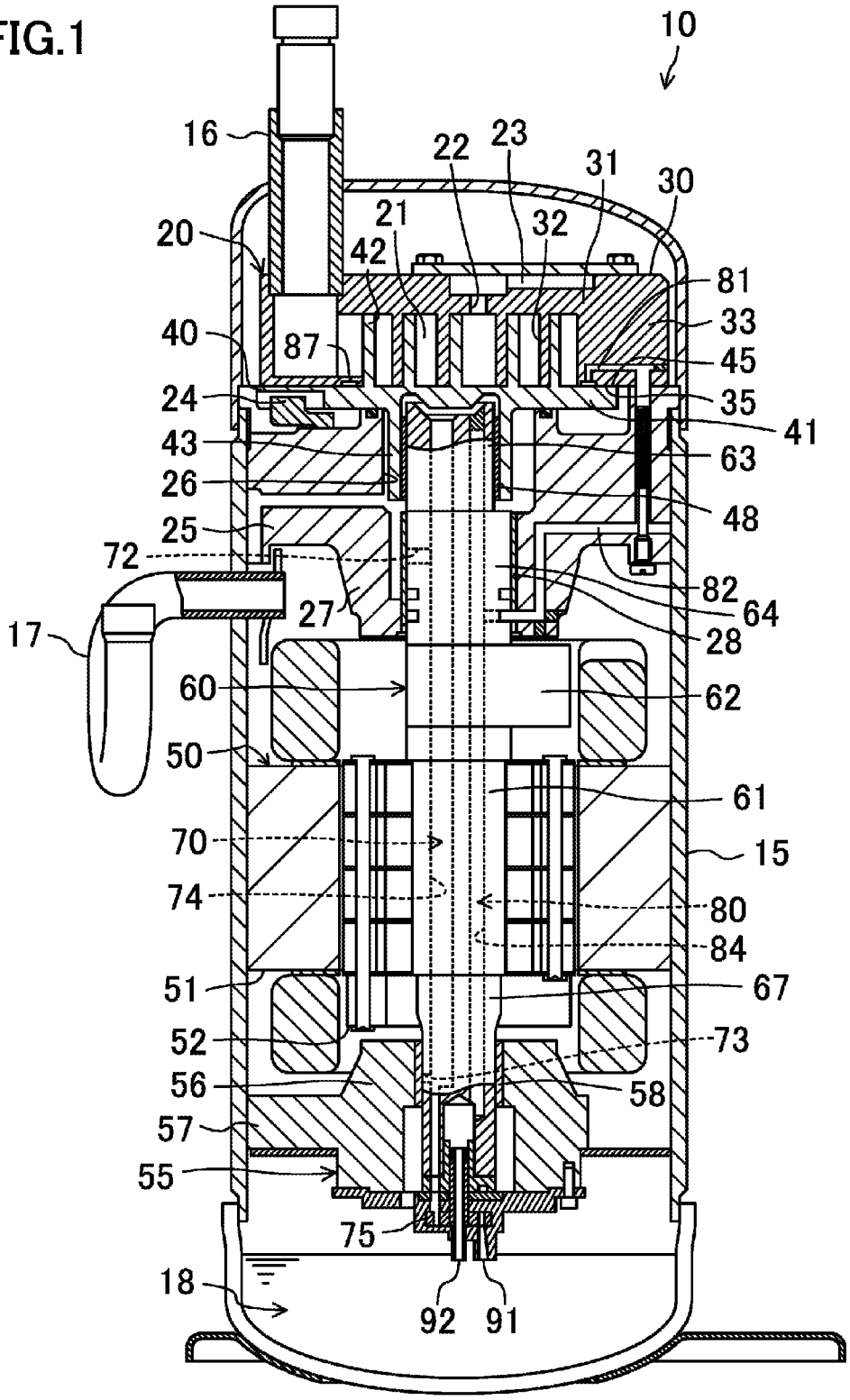
FIG. 1 is a vertical sectional view illustrating an exemplary overall structure of a scroll compressor according to an embodiment of the present invention.

Embodiments of the present invention will now be described with reference to the accompanying drawings, in which any pair of members having the same or similar function is identified by the same reference numeral.

FIG. 1 is a vertical sectional view illustrating an exemplary overall structure of a scroll compressor (10) according to an embodiment of the present invention. The scroll compressor (10) shown in FIG. 1 is a hermetic compressor. The scroll compressor (10) is connected to a refrigerant circuit, which performs a refrigeration cycle, to suck and compress a refrigerant in the refrigerant circuit.

<Overall Configuration for Scroll Compressor>

As illustrated in FIG. 1, the scroll compressor (10) has a casing (15) which houses, in its inner space, a compression mechanism (20), an electric motor (50), a lower bearing member (55), and a drive shaft (60). The casing (15) is a vertically elongated cylindrical hermetic container. The compression mechanism (20), the electric motor (50), and the lower bearing member (55) are arranged in this order from the top toward the bottom in the inner space of the casing (15). The drive shaft (60) is arranged such that its axial direction is parallel to the longitudinal direction of the casing (15). The compression mechanism (20) includes a housing (25), a fixed scroll (30), and an orbiting scroll (40). The structure of the compression mechanism (20) will be described in detail later.

A suction pipe (16) and a discharge pipe (17) are attached to the casing (15). Both of the suction pipe (16) and the discharge pipe (17) extend through the casing (15). The suction pipe (16) is connected to the compression mechanism (20). The compression mechanism (20) compresses a refrigerant that has flowed in as a fluid through the suction pipe (16), and discharges the compressed refrigerant into the casing (15). The discharge pipe (17) has an opening in the inner space of the casing (15) between the electric motor (50) and the compression mechanism (20).

The lower bearing member (55) has a central cylindrical portion (56) and an arm portion (57). Although FIG. 1 illustrates only one arm portion (57), the lower bearing member (55) actually has three arm portions (57). The central cylindrical portion (56) has an approximately cylindrical shape. Each of the arm portions (57) extends outward from the outer peripheral surface of the central cylindrical portion (56). The three arm portions (57) of the lower bearing member (55) are spaced apart from each other at substantially equal angles. Projecting ends of the respective arm portions (57) are fixed to the casing (15). A bearing metal (58) is inserted in the vicinity of an upper end portion of the central cylindrical portion (56). An auxiliary journal (67) of the drive shaft (60) to be described later is inserted in, and extends through, this bearing metal (58). The central cylindrical portion (56) functions as a journal bearing which supports the auxiliary journal (67).

The electric motor (50) has a stator (51) and a rotor (52). The stator (51) is fixed to the casing (15). The rotor (52) is arranged coaxially with the stator (51).

The drive shaft (60) includes a main shaft portion (61), a balance weight portion (62), and an eccentric portion (63). The balance weight portion (62) is disposed at a halfway point in the axial direction of the main shaft portion (61). A part of the main shaft portion (61) under the balance weight portion (62) extends through the rotor (52) of the electric motor (50). Another part of the main shaft portion (61) over the balance weight portion (62) functions as a main journal (64), and still another part of the main shaft portion (61) under the rotor (52) functions as the auxiliary journal (67). The main journal (64) is inserted in, and extends through, a bearing metal (28) provided inside a central bulge portion (27) of the housing (25). The auxiliary journal (67) is inserted in, and extends through, the bearing metal (58) provided inside the central cylindrical portion (56) of the lower bearing member (55).

The eccentric portion (63) has a columnar shape with a smaller diameter than the main journal (64), and projects from the upper end surface of the main journal (64). The axis of the eccentric portion (63) is parallel to the axis of the main journal (64) (i.e., the axis of the main shaft portion (61)), and is eccentric with the axis of the main journal (64). The eccentric portion (63) is inserted in a bearing metal (48) provided inside a cylindrical portion (43) of the orbiting scroll (40).

The drive shaft (60) is provided with a bearing oil supply passage (70), which includes a bearing main passage (74), an eccentric portion oil supply passage (71) (see FIG. 5), two branch passages (72, 73), and an oil supply pump (75). The main passage (74) extends along the axis of the drive shaft (60). One end of the main passage (74) has an opening at the lower end of the main shaft portion (61), and the other end thereof has an opening at the upper end surface of the eccentric portion (63). The eccentric portion oil supply passage (71) is also called a "D-cut", and functions as a drain for excess oil as well. The eccentric portion oil supply passage (71) is formed in the axial direction on a portion of the outer peripheral surface of the eccentric portion (63).

The second branch passage (72) is provided through the main journal (64). This second branch passage (72) extends radially outward from the main passage (74) toward the outer periphery of the main journal (64) to have an opening through the outer peripheral surface of the main journal (64). The third branch passage (73) is provided through the auxiliary journal (67). This third branch passage (73) extends radially outward from the main passage (74) toward the outer periphery of the auxiliary journal (67) to have an opening through the outer peripheral surface of the auxiliary journal (67).

Figure 2:
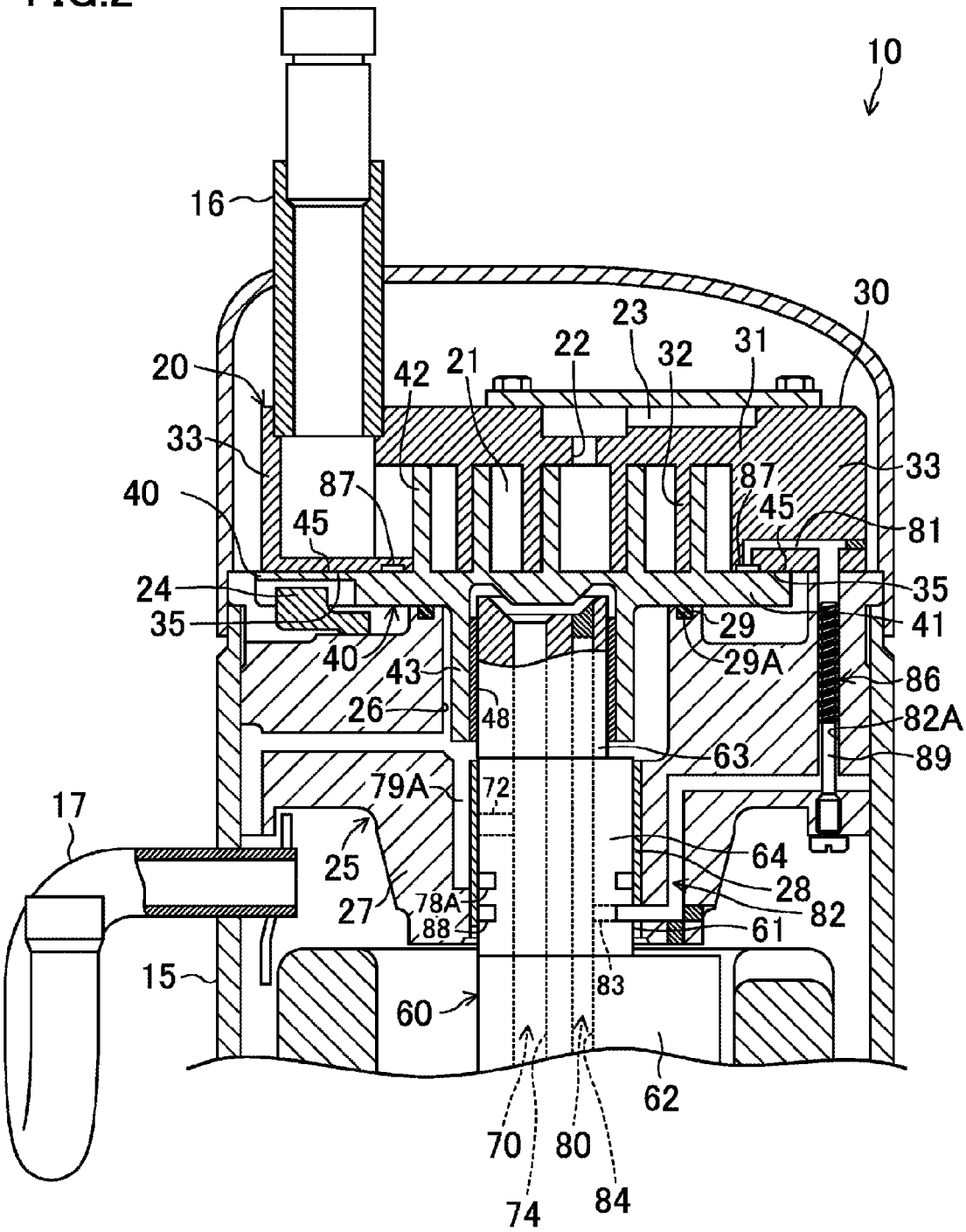
FIG. 2 is a vertical sectional view illustrating an exemplary structure of a principal part of the scroll compressor shown in FIG. 1.
Figure 3:
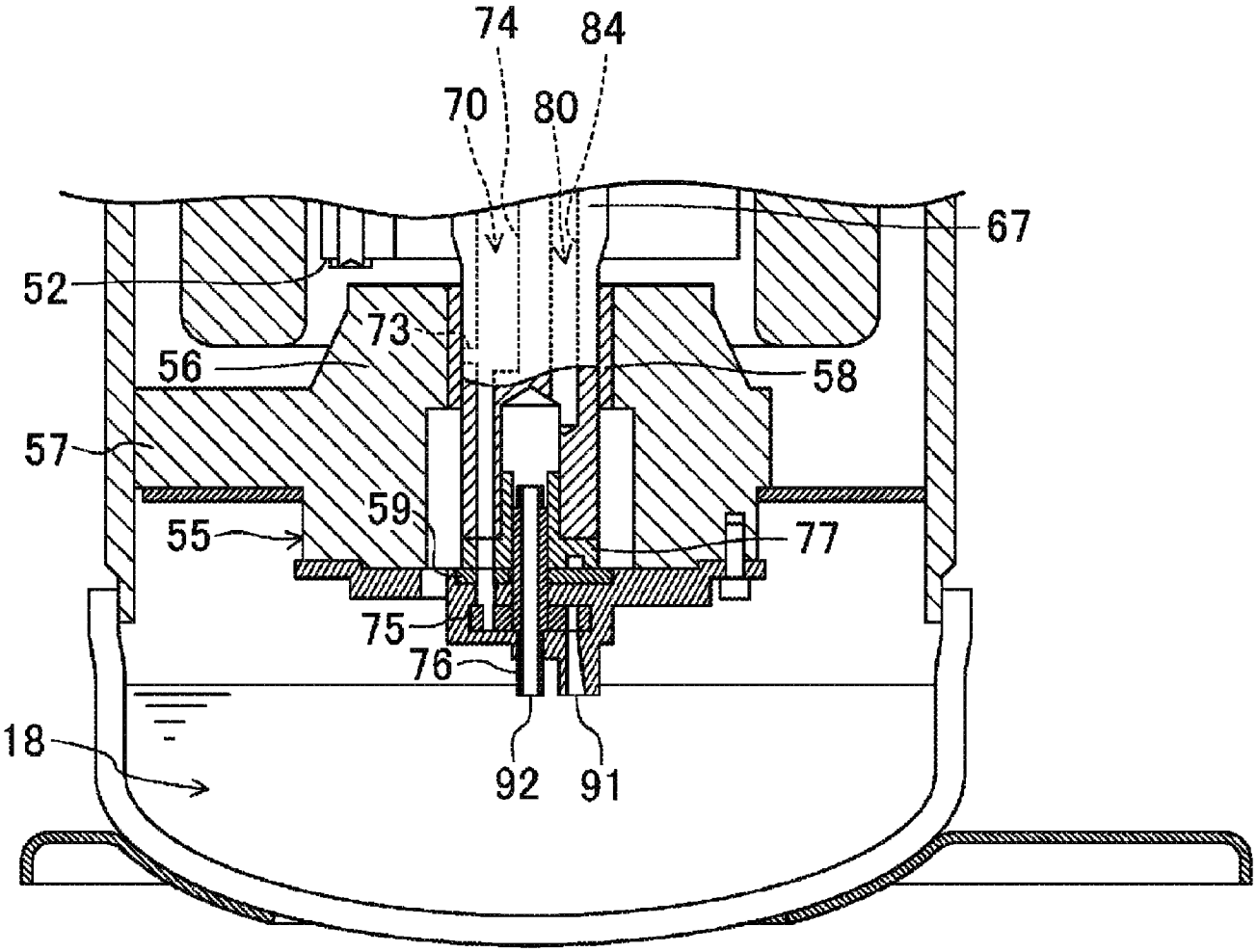
FIG. 3 is a vertical sectional view illustrating an exemplary structure of a portion of the scroll compressor shown in FIG. 1 around the lower end of the drive shaft thereof.

FIG. 2 is a vertical sectional view illustrating an exemplary structure of a principal part of the scroll compressor (10) shown in FIG. 1. FIG. 3 is a vertical sectional view illustrating an exemplary structure of a portion of the scroll compressor (10) shown in FIG. 1 around the lower end of the drive shaft (60) thereof. An oil supply pump shaft receiver (77) is fixed on the lower end of the drive shaft (60), and is in sliding contact with an axial thrust plate (59). The shaft (76) of the oil supply pump (75) is inserted in, and fixed on, the lower end of the drive shaft (60).

The oil supply pump (75) is a trochoid pump driven by the drive shaft (60). The oil supply pump (75) is arranged near the starting end of the main passage (74) of the bearing oil supply passage (70). The oil supply pump (75) sucks the lubricating oil through an inlet port (91), which is opened downward. Note that the oil supply pump (75) does not have to be the trochoid pump but may also be any positive displacement pump driven by the drive shaft (60). Thus, the oil supply pump (75) may be a yoke pump, for example. The bearing oil supply passage (70) is used to supply the lubricating oil to the journal bearing of the compression mechanism (20). The inlet port (91) of the oil supply pump (75) functions as a lubricating oil inlet port for the bearing oil supply passage (70).

The lubricating oil (such as a refrigeration oil) is accumulated at the bottom of the casing (15). That is, an oil reservoir (18) is provided at the bottom of the casing (15). As the drive shaft (60) rotates, the oil supply pump (75) sucks up the lubricating oil from the oil reservoir (18) and discharges that lubricating oil, which then flows through the main passage (74) via the through hole of the axial thrust plate (59) and the ring groove and through hole of the oil supply pump shaft receiver (77). The lubricating oil flowing through the main passage (74) is supplied to the lower bearing member (55) and the sliding portion between the compression mechanism (20) and the drive shaft (60). Since the oil supply pump (75) is a positive displacement pump, the flow rate of the lubricating oil in the main passage (74) is proportional to the rotational speed of the drive shaft (60).

As shown in FIG. 3, the shaft (76) of the oil supply pump (75) has a through hole extending in the longitudinal direction thereof and communicating with the sliding surface main passage (84). The lower opening of the shaft (76) constitutes a lubricating oil sucking port (92) of the sliding surface oil supply passage (80) to be described later.

<Configuration for Compression Mechanism>

Next, an exemplary configuration for the compression mechanism (20) will be described with reference to FIG. 2. The compression mechanism (20) is provided with an Oldham coupling (24) which regulates the rotational movement of the orbiting scroll (40).

The housing (25) has a disk shape with a large wall thickness, and the outer peripheral edge of the housing (25) is secured to the casing (15). The housing (25) has a central recess (26) and an annular projection (29) in its central portion. The central recess (26) is a recess which has a circular column shape and opens through the upper surface of the housing (25). The annular projection (29) is formed along the outer periphery of the central recess (26) and projects from the upper surface of the housing (25). The annular projection (29) has a flat top surface on which a ringlike recessed groove has been cut in the circumferential direction thereof. A seal ring (29A) is fitted in the recessed groove.

The housing (25) has a central bulge portion (27). The central bulge portion (27) is located under the central recess (26) and bulges downward. The central bulge portion (27) has a through hole which vertically extends through the central bulge portion (27). The bearing metal (28) is inserted into this through hole. The main journal (64) of the drive shaft (60) is inserted in, and extends through, the bearing metal (28) in the central bulge portion (27). The central bulge portion (27) functions as a journal bearing which supports the main journal (64).

The fixed scroll (30) and the orbiting scroll (40) are mounted on the housing (25). The fixed scroll (30) is secured to the housing (25) with bolts or any other fixing members. On the other hand, the orbiting scroll (40) is engaged with the housing (25) via the Oldham coupling (24), and is provided movably relative to the housing (25). The orbiting scroll (40), which is engaged with the drive shaft (60), performs orbital motion.

The orbiting scroll (40) is a member in which an orbiting scroll end plate (41), an orbiting scroll wrap (42), and a cylindrical portion (43) are integrated together. The orbiting scroll end plate (41) has a disk shape. The orbiting scroll wrap (42) is formed in the shape of an involute wall, and protrudes from the front side of the orbiting scroll end plate (41) (i.e. from the upper surface of the end plate (41) in FIGS. 1 and 2). The cylindrical portion (43) is formed in a cylindrical shape and protrudes from the rear side of the orbiting scroll end plate (41) (i.e. from the lower surface of the end plate (41) in FIGS. 1 and 2).

The rear side of the end plate (41) of the orbiting scroll (40) is in sliding contact with the seal ring (29A) fitted in the annular projection (29) of the housing (25). On the other hand, the cylindrical portion (43) of the orbiting scroll (40) is inserted downward into the central recess (26) of the housing (25). The bearing metal (48) is inserted into the cylindrical portion (43). The eccentric portion (63) of the drive shaft (60) is inserted upward into the bearing metal (48) in the cylindrical portion (43). The cylindrical portion (43) functions as a journal bearing which slides on the eccentric portion (63).

The fixed scroll (30) is a member in which a fixed scroll end plate (31), a fixed scroll wrap (32), and an outer peripheral portion (33) are integrated together. The fixed scroll end plate (31) is formed in a disk shape. The fixed scroll wrap (32) is formed in the shape of an involute wall, and protrudes from the front side of the fixed scroll end plate (31) (i.e. from the lower surface of the end plate (31) in FIGS. 1 and 2). The outer peripheral portion (33) is formed in the shape of a ring with a large wall thickness, and extends downward from the fixed scroll end plate (31) to surround the fixed scroll wrap (32).

The fixed scroll end plate (31) has a discharge port (22). The discharge port (22) is a through hole cut through around the center of the fixed scroll end plate (31), and extends through the fixed scroll end plate (31) in the thickness direction. A main suction hole (not shown) and an auxiliary suction hole (not shown, either) are also cut through around the outer peripheral portion of the fixed scroll end plate (31), and the suction pipe (16) is inserted into the main suction hole.

The compression mechanism (20) has a discharged gas passage (23). The discharged gas passage (23) has a starting end which communicates with the discharge port (22). Although not shown, the discharged gas passage (23) extends from the fixed scroll (30) through the housing (25), and the other end thereof opens through the lower surface of the housing (25).

In the compression mechanism (20), the fixed scroll (30) and the orbiting scroll (40) are arranged such that the front side of the fixed scroll end plate (31) faces the front side of the orbiting scroll end plate (41) and that the fixed scroll wrap (32) and the orbiting scroll wrap (42) are engaged with each other. Thus, in the compression mechanism (20), a plurality of compression chambers (21) are formed by having the fixed scroll wrap (32) and the orbiting scroll wrap (42) engaged with each other.

In addition, in the compression mechanism (20), the end plate (41) of the orbiting scroll (40) is in sliding contact with the outer peripheral portion (33) of the fixed scroll (30). Specifically, a portion of the front side of the orbiting scroll end plate (41) (i.e. the upper surface of the end plate (41) in FIGS. 1 and 2) which is located closer to the outer periphery than the orbiting scroll wrap (42) serves as an orbiting scroll thrust sliding surface (45) which comes into sliding contact with the fixed scroll (30). On the other hand, in the outer peripheral portion (33) of the fixed scroll (30), its projecting end surface (i.e., the lower surface in FIGS. 1 and 2) comes into sliding contact with the thrust sliding surface (45) of the orbiting scroll (40). In the outer peripheral portion (33), that portion of the projecting end surface that comes into sliding contact with the orbiting scroll thrust sliding surface (45) serves as a fixed scroll thrust sliding surface (35).

Figure 4:
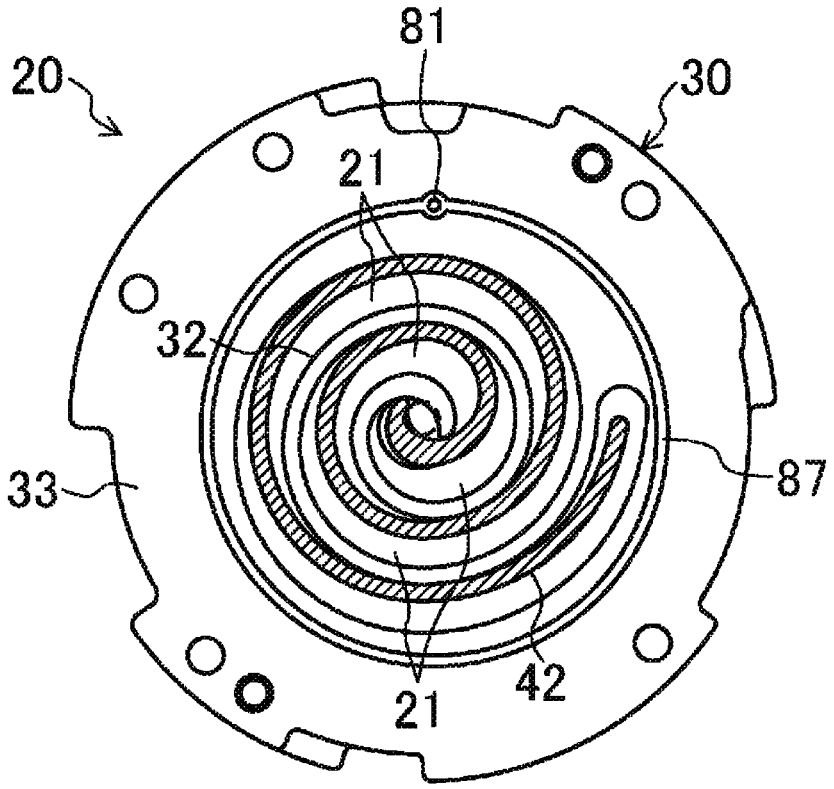
FIG. 4 is a cross-sectional view illustrating an exemplary structure of a compression mechanism of the scroll compressor shown in FIG. 1.

FIG. 4 is a cross-sectional view illustrating an exemplary structure of the compression mechanism (20) of the scroll compressor (10) shown in FIG. 1. As illustrated in FIGS. 2 and 4, the outer peripheral portion (33) of the fixed scroll (30) has an oil groove (87). The oil groove (87) is a recessed groove formed on the fixed scroll thrust sliding surface (35) of the outer peripheral portion (33), and has the shape of a ring surrounding the fixed scroll wrap (32).

<Sliding Surface Oil Supply Passage>

As illustrated in FIGS. 2 and 4, the scroll compressor (10) further has a sliding surface oil supply passage (80). The sliding surface oil supply passage (80) includes a first connecting passage (81) provided inside the fixed scroll (30), a second connecting passage (82) provided inside the housing (25), a third connecting passage (83) provided inside the drive shaft (60), and a sliding surface main passage (84) provided inside the drive shaft (60).

The first connecting passage (81) is formed in the outer peripheral portion (33) of the fixed scroll (30). One end of the first connecting passage (81) communicates with the oil groove (87) formed on the fixed scroll thrust sliding surface (35). The first connecting passage (81) extends from the one end toward the outer periphery of the outer peripheral portion (33). The other end of the first connecting passage (81) has an opening through a surface in contact with the housing (25). The first connecting passage (81) communicates with the second connecting passage (82).

Figure 5:
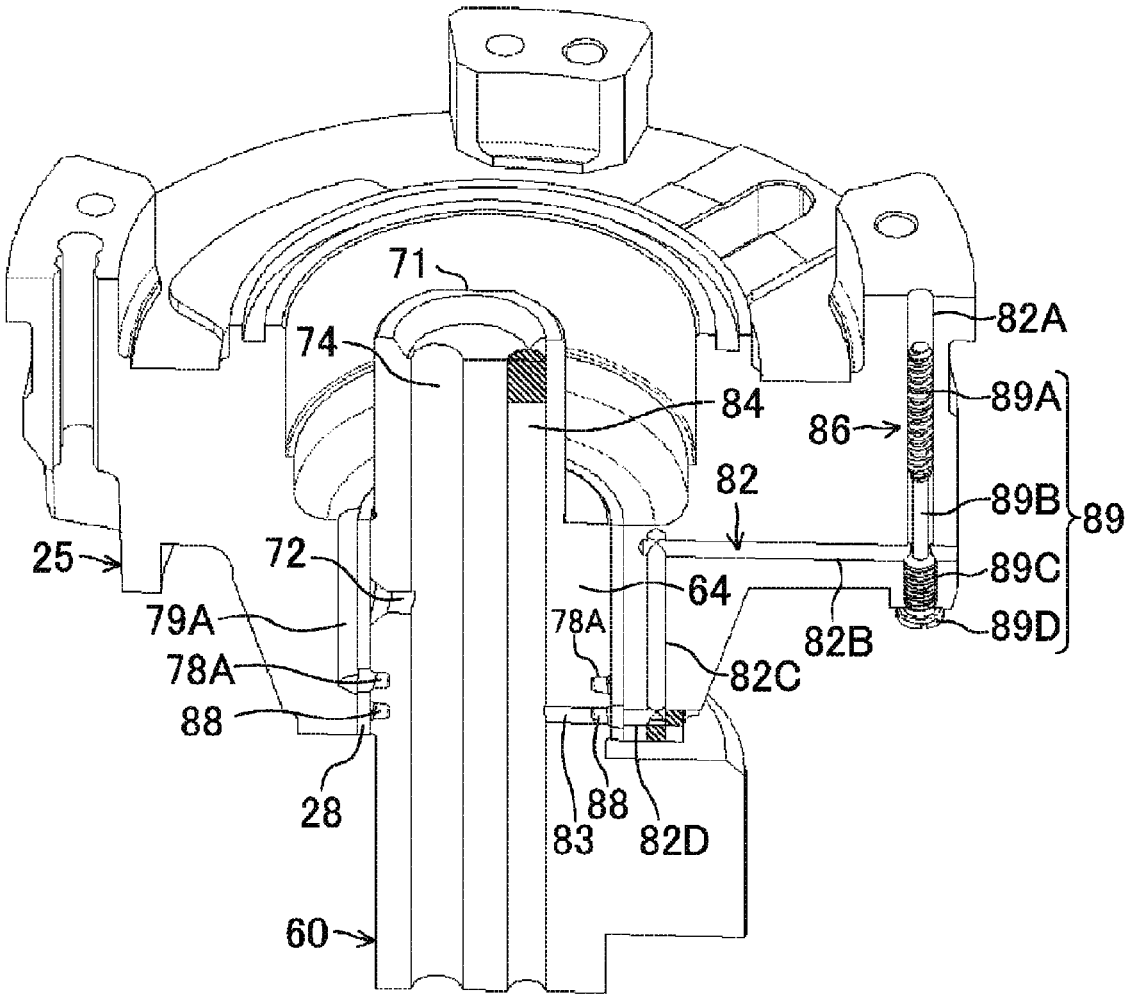
FIG. 5 is a perspective view illustrating an exemplary structure of a drive shaft and housing of the scroll compressor shown in FIG. 1.

FIG. 5 is a perspective view illustrating an exemplary structure of the drive shaft (60) and housing (25) of the scroll compressor (10) shown in FIG. 1. As shown in FIGS. 2 and 5, the second connecting passage (82) includes a vertical communication hole (82A) extending vertically through an outer peripheral portion of the housing (25), lateral communication holes (82B, 82D) extending radially through the housing (25), and another vertical communication hole (82C) extending vertically through an inner peripheral portion of the housing (25).

The vertical communication hole (82A) is formed to have an opening through the upper end surface of the housing (25) and communicate with the first connecting passage (81). The lower end of the vertical communication hole (82A) has an opening through the lower surface of the outer peripheral portion of the housing (25). A wall portion forming a lower end part of the vertical communication hole (82A) has a female screw. A rod member (89) to be described later is provided in the vertical communication hole (82A), of which the lower end is closed with a head portion (89D) of the rod member (89).

The lateral communication hole (82B) extends radially inward from right over the female screw of the vertical communication hole (82A) and has its outer end closed by the casing (15). The vertical communication hole (82C) extends downward from a position slightly closer to the outer periphery than the inner end of the lateral communication hole (82B) is. The lateral communication hole (82D) extends radially inward from around the lower end of the vertical communication hole (82C) and its inner end has an opening through the inner surface of the housing (25). Thus, the vertical communication hole (82A), lateral communication hole (82B), vertical communication hole (82C), and lateral communication hole (82D) communicate with each other in this order, thereby forming the second connecting passage (82) that connects the first connecting passage (81) to the inner surface of the housing (25).

As shown in FIGS. 2 and 5, the rod member (89) provided in the vertical communication hole (82A) of the second connecting passage (82) includes a body portion (89A) formed continuously from its tip end toward its base end, a reduced-diameter portion (89B), a screw portion (89C), and a head portion (89D). The body portion (89A) is configured as a circular columnar rod and has a narrow spiral groove (89E) with a width of approximately 0.5 to 1.0 mm on its outer peripheral portion. The body portion (89A) with such a configuration forms a narrow spiral passage in the gap between itself and the wall surface of the vertical communication hole (82A). The reduced-diameter portion (89B) is formed to have a smaller diameter than the vertical communication hole (82A), and forms an annular passage in the gap between itself and the wall surface of the vertical communication hole (82A). One end of the lateral communication hole (82B) opens into this annular passage. The screw portion (89C) is configured as a circular columnar rod, and has, on its outer peripheral portion, a male screw to be screwed into the female screw forming the lower end part of the vertical communication hole (82A). The head portion (89D) is formed in the shape of a disk having a larger diameter than the vertical communication hole (82A).

Such a rod member (89) has its body portion (89A) form a narrow spiral passage in the vertical communication hole (82A) provided with the rod member (89). Thus, the lubricating oil flowing into the vertical communication hole (82A) has its flow rate controlled in the narrow spiral passage formed on the outer periphery of the rod member (89). That is to say, the rod member (89) and the vertical communication hole (82A) form a throttle (86) for controlling the flow rate of the lubricating oil flowing through the sliding surface oil supply passage (80).

The outer peripheral surface of the main journal (64) of the drive shaft (60) has a lower ring groove (78A) under the opening of the second branch passage (72). The outer peripheral surface of the main journal (64) also has an oil supply ring groove (88) communicating with the second and third connecting passages (82, 83) and provided under the lower ring groove (78A). The bearing metal (28) has a through hole at a position corresponding to the opening of the lateral communication hole (82D). The third connecting passage (83) is provided through the main journal (64). The third connecting passage (83) extends radially outward from the sliding surface main passage (84) toward the outer periphery of the main journal (64), and communicates with the oil supply ring groove (88). That is to say, the third connecting passage (83) communicates with the second connecting passage (82) and the sliding surface main passage (84).

The lower ring groove (78A) collects the lubricating oil that flows downward after having been supplied to the bearing through the second branch passage (72). The housing (25) has an oil collecting vertical hole (79A). The bearing metal (28) has a through hole so as to allow the lower ring groove (78A) and the oil collecting vertical hole (79A) to communicate with each other. The oil collected in the lower ring groove (78A) flows into the central recess (26) through the oil collecting vertical hole (79A), and then goes back to the oil reservoir (18) in the end.

The sliding surface main passage (84) extends along the axis of the drive shaft (60), and has one end thereof reach the lower end of the main shaft portion (61). The other end of the sliding surface main passage (84) is closed at the upper end of the eccentric portion (63) and not opened.

The sliding surface oil supply passage (80) connects the oil groove (87) to the oil reservoir (18) in the casing (15), and supplies the lubricating oil to the oil groove (87). In other words, the lubricating oil in the oil reservoir (18) flows in through the sucking port (92), flows through the sliding surface main passage (84), third connecting passage (83), second connecting passage (82), and first connecting passage (81) in this order, and then is supplied to the oil groove (87). The bearing oil supply passage (70) provided through the drive shaft (60) does not communicate with the oil groove (87) formed on the fixed scroll (30). Thus, only the pressure difference between the oil reservoir (18) in the casing (15) and the oil groove (87) causes the lubricating oil to flow through the sliding surface oil supply passage (80).

—Operation—

Now, it will be described how this scroll compressor (10) operates.

<Operation of Compressing Refrigerant>

In the scroll compressor (10), when the electric motor (50) is supplied with power, the drive shaft (60) drives the orbiting scroll (40). The orbiting scroll (40) has its rotation regulated by the Oldham coupling (24), and therefore, performs only orbital motion without rotating.

As the orbiting scroll (40) moves along its orbit, a low-pressure gaseous refrigerant that has flowed into the compression mechanism (20) through the suction pipe (16) is sucked into the compression chamber (21) from around outer ends of the fixed scroll wrap (32) and orbiting scroll wrap (42). As the orbiting scroll (40) further moves, the compression chamber (21) becomes isolated from the suction pipe (16) to enter a completely closed state. The compression chamber (21) then moves along the fixed scroll wrap (32) and the orbiting scroll wrap (42) toward their inner ends. During this movement, the volume of the compression chamber (21) gradually decreases, and the gaseous refrigerant in the compression chamber (21) is gradually compressed accordingly.

As the compression chamber (21) has its volume decreased gradually through the movement of the orbiting scroll (40), the compression chamber (21) finally communicates with the discharge port (22). Then, the refrigerant compressed in the compression chamber (21) (i.e., a high-pressure gaseous refrigerant) flows through the discharge port (22) to enter the discharge gas passage (23), and then is discharged into the inner space of the casing (15). In the inner space of the casing (15), the high-pressure gaseous refrigerant discharged from the compression mechanism (20) is once guided to under the stator (51) of the electric motor (50), and then allowed to flow upward through, e.g., the gap between the rotor (52) and the stator (51). Thereafter, the gaseous refrigerant passes through the discharge pipe (17) and flows out of the casing (15).

In the inner space of the casing (15), the high-pressure gaseous refrigerant discharged from the compression mechanism (20) flows through a part of the inner space under the housing (25), and its pressure becomes substantially equal to that of the high-pressure gaseous refrigerant. Thus, the lubricating oil accumulated in the oil reservoir (18) in the casing (15) also has a pressure substantially equal to that of the high-pressure gaseous refrigerant.

On the other hand, although not shown, the rest of the inner space of the casing (15) over the housing (25) communicates with the suction pipe (16), and its pressure becomes approximately equal to that of the low-pressure gaseous refrigerant sucked into the compression mechanism (20). Thus, in the compression mechanism (20), the space around the outer periphery of the end plate (41) of the orbiting scroll (40) also has a pressure approximately equal to that of the low-pressure gaseous refrigerant.

<Operation of Supplying Oil to Compression Mechanism>

While the scroll compressor (10) is operating, the drive shaft (60) rotating drives the oil supply pump (75), and the lubricating oil accumulated at the bottom of the casing (15) is sucked and supplied to the main passage (74) of the bearing oil supply passage (70). Part of the lubricating oil flowing through the main passage (74) flows into the branch passages (72, 73) and the rest of the lubricating oil reaches the upper end of the main passage (74).

The lubricating oil that has reached the upper end of the main passage (74) flows into the eccentric portion oil supply passage (71). Part of that oil is supplied to the gap between the eccentric portion (63) and the bearing metal (48) and used to lubricate and cool the eccentric portion (63) and the bearing metal (48). The rest of the oil flows out as excessive oil into the space of the central recess (26). The lubricating oil that has flowed into the second branch passage (72) is supplied to the gap between the main journal (64) and the bearing metal (28) and used to lubricate and cool the main journal (64) and the bearing metal (28). The lubricating oil that has flowed into the third branch passage (73) is supplied to the gap between the auxiliary journal (67) and the bearing metal (58) and used to lubricate and cool the auxiliary journal (67) and the bearing metal (58). In addition, in the compression mechanism (20), the sliding parts between the orbiting scroll (40) and the Oldham coupling (24) and the sliding parts between the orbiting scroll (40) and the fixed scroll (30) are also supplied with the lubricating oil.

<Operation of Pressing Orbiting Scroll>

In the compression mechanism (20) of this embodiment, the rear side of the orbiting scroll end plate (41) is in sliding contact with the seal ring (29A). This seal ring (29A) keeps the internal pressure as high as the pressure of the discharged refrigerant. Consequently, pressing force (i.e., upward force in this embodiment) acts on the orbiting scroll (40) so as to press the orbiting scroll (40) toward the fixed scroll (30). As a result, even while the compression mechanism (20) is operating, the orbiting scroll (40) is kept pressed against the fixed scroll (30), thereby ensuring air tightness for the compression chambers (21).

However, the pressing force acting on the orbiting scroll (40) sometimes becomes too strong. The excessively strong pressing force increases the frictional force produced between the orbiting scroll (40) and the fixed scroll (30), thus eventually causing an increase in the power consumption of the electric motor (50).

To overcome this problem, in the scroll compressor (10) of this embodiment, the oil groove (87) communicates with the oil reservoir (18) in the casing (15) through the sliding surface oil supply passage (80) and is kept filled with the high-pressure lubricating oil. On the other hand, the pressure in the compression chamber (21) adjacent to the oil groove (87) (i.e., the compression chamber (21) formed near the outermost portions of the wraps (32, 42)) is approximately as high as that of the low-pressure refrigerant sucked into the compression chamber (21), and is lower than the pressure of the lubricating oil in the oil groove (87). Consequently, the lubricating oil in the oil groove (87) gradually flows out into the clearance between the orbiting and fixed scroll thrust sliding surfaces (45, 35) and used to lubricate these thrust sliding surfaces (45, 35).

In this manner, the scroll compressor (10) of this embodiment ensures that the lubricating oil is supplied to the clearance between the orbiting and fixed scroll thrust sliding surfaces (45, 35). Thus, even if the orbiting scroll (40) is strongly pressed against the fixed scroll (30), the frictional force produced between their thrust sliding surfaces (45, 35) does not become excessively strong.

<Operation to be Performed when Orbiting Scroll Tilts>

In the orbiting scroll (40) of the scroll compressor (10), the internal pressure of the compression chambers (21) acts on the orbiting scroll wrap (42) protruding from the front side of the orbiting scroll end plate (41), and a load applied from the eccentric portion (63) acts on the cylindrical portion (43) protruding from the rear side of the orbiting scroll end plate (41). The line of action of the gas pressure acting on the orbiting scroll wrap (42) and the line of action of the load acting on the cylindrical portion (43) intersect with the axial direction of the orbiting scroll (40) at right angles, but do not intersect with each other. Thus, while the compression mechanism (20) is operating, a moment acts on the orbiting scroll (40) in such a direction as to tilt the orbiting scroll (40). If the pressing force acting on the orbiting scroll (40) is sufficiently strong, the orbiting scroll (40) does not tilt even when such a moment acts thereon.

However, in an operational state where the pressing force is not sufficiently strong, the orbiting scroll (40) may sometimes tilt so much as to increase the clearance between the orbiting and fixed scroll thrust sliding surfaces (45, 35). For example, the pressing force may be insufficient in an operational state where there is only a little pressure difference between the low-pressure gaseous refrigerant sucked into the compression mechanism (20) and the high-pressure gaseous refrigerant discharged from the compression mechanism (20).

As described above, in the compression mechanism (20), the pressure in the space near the outer periphery of the orbiting scroll end plate (41) is approximately as high as that of the low-pressure gaseous refrigerant sucked into the compression mechanism (20). On the other hand, if the orbiting scroll (40) tilts so much as to increase the clearance between the orbiting and fixed scroll thrust sliding surfaces (45, 35), the flow resistance of the lubricating oil in the clearance between these thrust sliding surfaces (45, 35) decreases. Thus, the tilt of the orbiting scroll (40) may cause a large amount of the lubricating oil to spout out from the oil groove (87) into the space near the outer periphery of the orbiting scroll end plate (41) and into the compression chamber adjacent to the oil groove (87).

To overcome this problem, the scroll compressor (10) of this embodiment provides a throttle (86) for the sliding surface oil supply passage (80). Thus, even if the orbiting scroll (40) tilts so much as to increase the clearance between the orbiting and fixed scroll thrust sliding surfaces (45, 35), the flow rate of the lubricating oil flowing through the sliding surface oil supply passage (80) may still be controlled by the throttle (86).

In this manner, in the compression mechanism (20) of this embodiment, even if the orbiting scroll (40) tilts, the flow rate of the lubricating oil flowing from the sliding surface oil supply passage (80) into the oil groove (87) may still be kept low.

In this case, if too little pressure loss is caused while the lubricating oil flows from one end through the other end of the sliding surface oil supply passage (80) and if the tilt of the orbiting scroll (40) causes a fall in the pressure in the oil groove (87), the flow rate of the lubricating oil flowing through the sliding surface oil supply passage (80) increases so steeply that a large amount of the lubricating oil spouts from the end of the sliding surface oil supply passage (80). On the other hand, if too much pressure loss is caused while the lubricating oil flows from one end through the other end of the sliding surface oil supply passage (80), an insufficient amount of the lubricating oil may be supplied to the clearance between the orbiting and fixed scroll thrust sliding surfaces (45, 35) in a normal state (i.e., a state where the orbiting scroll (40) is not tilted). Thus, in view of these considerations, the diameter and length of the throttle (86) are set according to this embodiment such that the pressure loss caused while the lubricating oil flows from one end through the other end of the sliding surface oil supply passage (80) has an appropriate value. Note that the throttle (86) does not have to be the exemplary one described above but may be replaced with any other member as long as the pressure loss may be regulated to an appropriate value.

Advantages of Embodiment

According to this embodiment, the thrust sliding surface (35) of the fixed scroll (30) is provided with an oil groove (87). Also, the bearing oil supply passage (70) that supplies the lubricating oil to the journal bearing of the compression mechanism (20) does not communicate with this oil groove (87). That is why even if the pressure in the oil groove (87) fell steeply due to a tilt of the orbiting scroll (40) while the compression mechanism (20) is operating, the pressure in the bearing oil supply passage (70) would not change.

Suppose the oil groove (87) and the bearing oil supply passage (70) communicate with each other. In that case, if the pressure in the oil groove (87) falls steeply, then the pressure in the bearing oil supply passage (70) also falls accordingly. Such a fall in the pressure in the bearing oil supply passage (70) may allow the lubricating oil to flow in reverse direction from the journal bearing of the compression mechanism (20) to the bearing oil supply passage (70) and eventually cause a shortage of the lubricating oil to lubricate the journal bearing.

According to this embodiment, however, the bearing oil supply passage (70) does not communicate with the oil groove (87), and therefore, the pressure in the bearing oil supply passage (70) does not change even if the pressure falls steeply in the oil groove (87). Thus, according to this embodiment, even if the orbiting scroll (40) tilts so much as to cause a steep fall in the pressure in the oil groove (87), the lubricating oil does not flow back from the journal bearing of the compression mechanism (20) toward the bearing oil supply passage (70) but may be supplied continuously with reliability to the journal bearing of the compression mechanism (20) through the bearing oil supply passage (70). This thus allows the journal bearing of the compression mechanism (20) to be constantly lubricated with reliability while avoiding seizure and other inconveniences. Consequently, the reliability of this scroll compressor (10) does increase.

As described above, if too little pressure loss is caused while the lubricating oil flows from one end through the other end of the sliding surface oil supply passage (80) and if the orbiting scroll (40) tilts so much as to increase the clearance between the orbiting and fixed scroll thrust sliding surfaces (45, 35), a large amount of the lubricating oil spouts from the end of the sliding surface oil supply passage (80). On the other hand, if too much pressure loss is caused while the lubricating oil flows from one end through the other end of the sliding surface oil supply passage (80), an insufficient amount of the lubricating oil may be supplied to the clearance between the orbiting and fixed scroll thrust sliding surfaces (45, 35).

To overcome this problem, the sliding surface oil supply passage (80) is provided according to this embodiment with a rod member (89) functioning as the throttle (86), thereby setting the pressure loss caused while the lubricating oil flows from one end through the other end of the sliding surface oil supply passage (80) to be an appropriate value. This thus allows an unwanted situation to be avoided where the lubricating oil flows through the sliding surface oil supply passage (80) at an excessively high flow rate, even if the orbiting scroll (40) tilts. Consequently, even if the orbiting scroll (40) tilts, the flow rate of the lubricating oil flowing from the sliding surface oil supply passage (80) into the oil groove (87) may still be controlled. In addition, once the orbiting scroll (40) recovers its original position, the pressure in the oil groove (87) may be raised rapidly enough to ensure that a sufficient amount of the oil is supplied to the clearance between the orbiting and fixed scroll thrust sliding surfaces (45, 35).

Furthermore, since the sliding surface main passage (84) is provided inside the drive shaft (60), there is no need to reduce the size of any member (e.g., the stator (51) of the electric motor (50)) of the scroll compressor (10) in order to provide a passage to supply oil to the oil groove (87). Thus, the performance of the scroll compressor (10) does not have to be sacrificed to supply the oil to the orbiting and fixed scroll thrust sliding surfaces (45, 35).

—First Variation—

Figure 6:
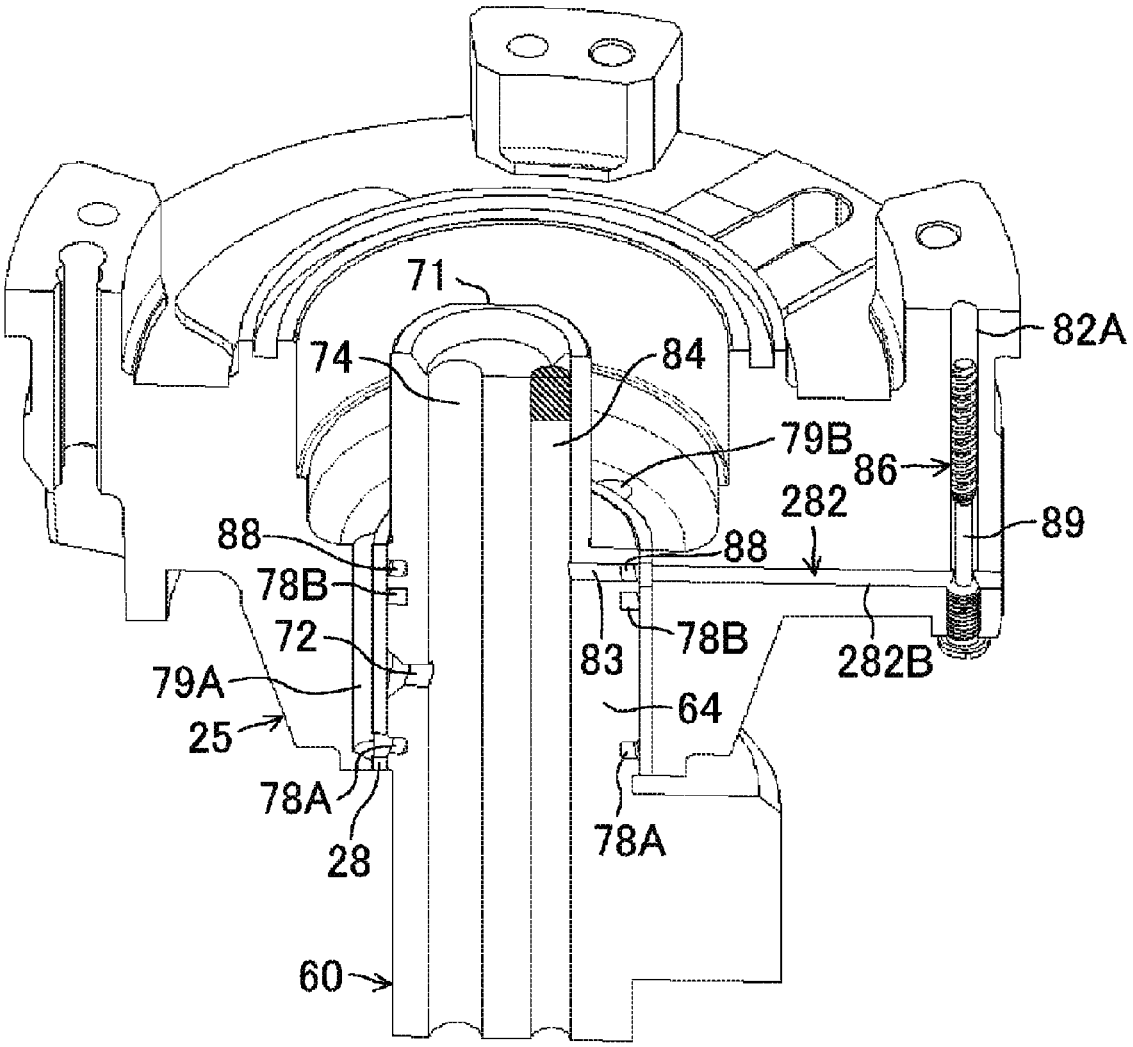
FIG. 6 is a perspective view illustrating an exemplary structure of a drive shaft and housing according to a first variation of the scroll compressor shown in FIG. 1.

FIG. 6 is a perspective view illustrating an exemplary structure of a drive shaft (60) and housing (25) according to a first variation of the scroll compressor (10) shown in FIG. 1. The following description of the first variation will be focused on only differences from the scroll compressor that has already been described with reference to FIGS. 1 through 5. In the other respects, the scroll compressor of this variation is the same as what has already been described with reference to FIGS. 1 through 5.

As shown in FIG. 6, a second connecting passage (282) includes a vertical communication hole (82A) extending vertically through an outer peripheral portion of the housing (25) and a lateral communication hole (282B) extending radially through the housing (25). The lateral communication hole (282B) extends radially inward from right over a female screw of the vertical communication hole (82A) and has its inner end opened through the inner surface of the housing (25). Note that the outer end of the lateral communication hole (282B) is closed.

The outer peripheral surface of the main journal (64) of the drive shaft (60) has an upper ring groove (78B) over the opening of the second branch passage (72). The outer peripheral surface of the main journal (64) also has an oil supply ring groove (88) communicating with the second and third connecting passages (282, 83) and provided over the upper ring groove (78B). The bearing metal (28) has a through hole at a position corresponding to the opening of the lateral communication hole (282B). The third connecting passage (83) extends radially outward from the sliding surface main passage (84) toward the outer periphery of the main journal (64), and communicates with the oil supply ring groove (88).

Figure 7:
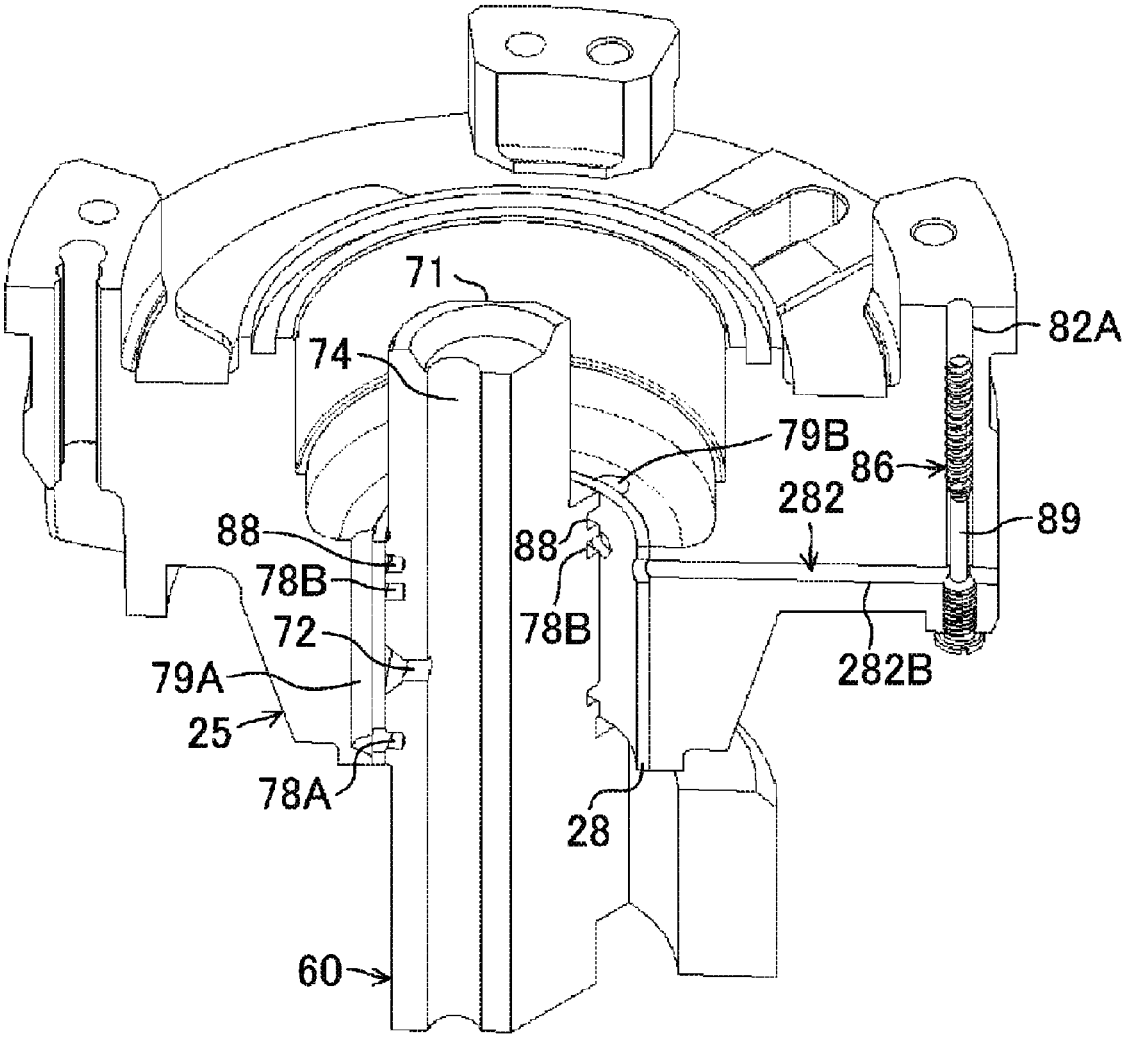
FIG. 7 is a perspective view illustrating portions of the drive shaft and housing shown in FIG. 6 which are associated with its upper ring groove.

FIG. 7 is a perspective view illustrating portions of the drive shaft (60) and housing (25) shown in FIG. 6 which are associated with the upper ring groove (78B). The upper ring groove (78B) collects the lubricating oil that flows upward after having been supplied to the bearing through the second branch passage (72). The housing (25) has an oil collecting vertical hole (79B). The bearing metal (28) has a through hole so as to allow the upper ring groove (78B) and the oil collecting vertical hole (79B) to communicate with each other. The oil collected in the upper ring groove (78B) flows out into the central recess (26) of the housing (25) through the oil collecting vertical hole (79B), and then goes back to the oil reservoir (18) in the end.

As can be seen, the scroll compressor (10) may have an upper ring groove (78B) and an oil supply ring groove (88) over the upper ring groove (78B). According to this configuration, the opening of the second connecting passage (282) may be located at a higher vertical level on the inner surface of the housing (25). Thus, the second connecting passage (282) may have its structure simplified.

—Second Variation—

Figure 8:
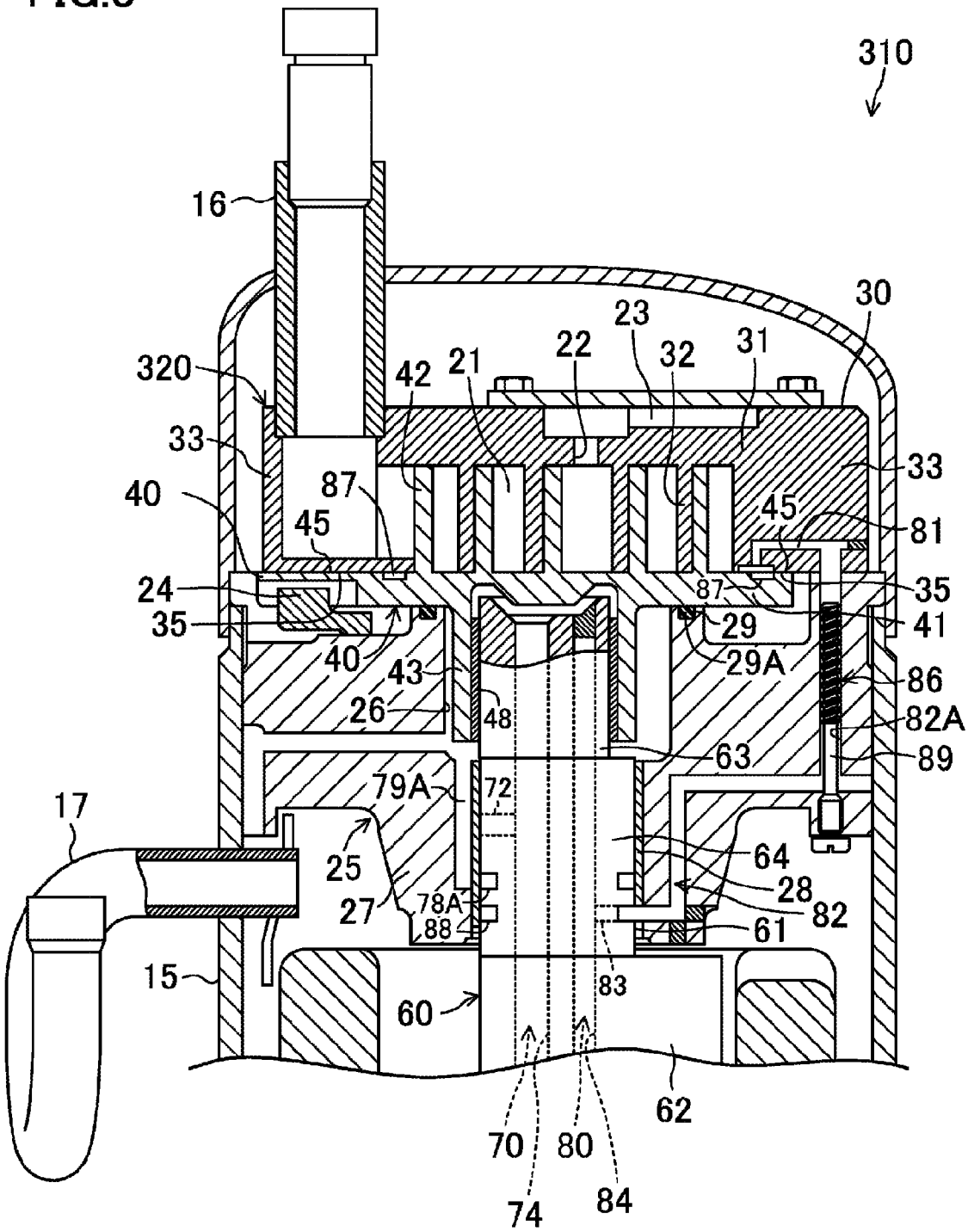
FIG. 8 is a vertical sectional view illustrating an exemplary structure of a principal part according to a second variation of the scroll compressor shown in FIG. 1.

FIG. 8 is a vertical sectional view illustrating an exemplary structure of a principal part according to a second variation of the scroll compressor (10) shown in FIG. 1. The scroll compressor (310) shown in FIG. 8 has the same configuration as the scroll compressor (10) shown in FIG. 1, except that the scroll compressor (310) includes a compression mechanism (320) in place of the compression mechanism (20). In this compression mechanism (320), an oil groove (87) is cut on the orbiting scroll (40), not on the fixed scroll (30). Specifically, the oil groove (87) is cut on the end plate (41) of the orbiting scroll (40). This oil groove (87) is a recessed groove cut on the thrust sliding surface (45) of the end plate (41) of the orbiting scroll (40) and formed in the shape of a ring surrounding the orbiting scroll wrap (42). Also, the end of the first connecting passage (81) has an opening through the thrust sliding surface (35) of the fixed scroll (30). This end of the first connecting passage (81) has a width broad enough to allow the first connecting passage (81) to keep communicating with the oil groove (87) even if the orbiting scroll (40) has moved.

Just like the scroll compressor (10) shown in FIG. 1, the bearing oil supply passage (70) does not communicate, in the scroll compressor (310) shown in FIG. 8, with the oil groove (87), either, only the pressure difference between the oil reservoir (18) in the casing (15) and the oil groove (87) causes the lubricating oil to flow through the sliding surface oil supply passage (80), and the sliding surface oil supply passage (80) is provided with the throttle (86). Thus, the scroll compressor (10) shown in FIG. 8 achieves the same effects as the scroll compressor (10) shown in FIG. 1.

The many features and advantages of the present invention are apparent from the written description, and thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

INDUSTRIAL APPLICABILITY

As can be seen from the foregoing description, the present invention is useful, for example, as a scroll compressor to compress a refrigerant or any other given fluid.

What is claimed is:

1. A scroll compressor comprising:

a compression mechanism including a fixed scroll and an orbiting scroll, the fixed scroll having a fixed scroll thrust sliding surface, and the orbiting scroll having an end plate with an orbiting scroll thrust sliding surface pressed against and in sliding contact with the fixed scroll thrust sliding surface;

a drive shaft engaging with the orbiting scroll; and a casing housing the compression mechanism and the drive shaft, the scroll compressor being configured to cause the compression mechanism to compress a fluid and discharge the fluid into the casing, one of the orbiting scroll thrust sliding surface or the fixed scroll thrust sliding surface being provided with an oil groove into which lubricating oil flows, a bearing oil supply passage provided inside the drive shaft does not communicate with the oil groove and is used to supply the lubricating oil in an oil reservoir in the casing to a bearing of the drive shaft, a sliding surface oil supply passage being used to supply the lubricating oil in the oil reservoir to the oil groove, and the sliding surface oil supply passage having a sliding surface main passage provided inside the drive shaft, wherein the compression mechanism has a housing with the drive shaft inserted therein, and the sliding surface oil supply passage further includes a first connecting passage provided inside the fixed scroll and communicating with the oil groove, a second connecting passage provided inside the housing and communicating with the first connecting passage, and a third connecting passage provided inside the drive shaft and communicating with the second connecting passage and the sliding surface main passage.

2. The scroll compressor of claim 1, wherein the sliding surface oil supply passage is configured such that a pressure difference between the oil reservoir and the oil groove causes the lubricating oil to flow through the sliding surface oil supply passage.

3. The scroll compressor of claim 2, wherein the sliding surface oil supply passage is provided with a throttle configured to control a flow rate of the lubricating oil.

4. The scroll compressor of claim 3, wherein the throttle includes a rod member inserted into the sliding surface oil supply passage, and an outer periphery of the rod member has a spiral groove that allows the lubricating oil to flow therethrough.

5. The scroll compressor of claim 1, wherein an outer peripheral surface of the drive shaft includes a lower ring groove configured to collect the lubricating oil that flows downward after having been supplied onto the bearing, and an oil supply ring groove provided under the lower ring groove and communicating with the second and third connecting passages.

6. The scroll compressor of claim 1, wherein an outer peripheral surface of the drive shaft includes an upper ring groove configured to collect the lubricating oil that flows upward after having been supplied onto the bearing, and an oil supply ring groove provided over the upper ring groove and communicating with the second and third connecting passages.

* * * * *